United States Patent [19]

Krajec et al.

[11] Patent Number: 4,664,672

[45] Date of Patent: May 12, 1987

[54] TRANSFER PRINTING PROCESS FOR SOLID OBJECTS EMPLOYING HIGH-PRESSURE GAS

[75] Inventors: Otmar Krajec; Walter Hellmann, both of Rossdorf, Fed. Rep. of Germany

[73] Assignee: Rohm GmbH Chemische Fabrik, Darmstadt, Fed. Rep. of Germany

[21] Appl. No.: 838,312

[22] Filed: Mar. 10, 1986

Related U.S. Application Data

[62] Division of Ser. No. 556,943, Dec. 1, 1983.

[30] Foreign Application Priority Data

Aug. 23, 1983 [DE] Fed. Rep. of Germany ..... 3244355
Nov. 29, 1983 [DE] Fed. Rep. of Germany ..... 3310432

[51] Int. Cl.[4] ..... B41M 1/30; B41M 5/26; D06P 5/13

[52] U.S. Cl. ..... 8/472; 8/471; 8/506; 8/509

[58] Field of Search ..... 8/471, 472

[56] References Cited

U.S. PATENT DOCUMENTS 4,231,743 11/1980 Buckwalter et al. ..... 8/471
4,242,092 12/1980 Glover ..... 8/472

FOREIGN PATENT DOCUMENTS 14901 9/1980 European Pat. Off. .
2642350 3/1978 Fed. Rep. of Germany .
1465390 2/1977 United Kingdom .
1586076 3/1981 United Kingdom .
2095619 10/1982 United Kingdom .
2105655 3/1983 United Kingdom .

*Primary Examiner*—A. Lionel Clingman
*Attorney, Agent, or Firm*—Oblon, Fisher, Spivak, McClelland & Maier

[57] ABSTRACT

A process for transfer printing onto solid substrates made of plastics or having a surface layer of varnish or plastic is described. According to the invention described a sheet dye carrier at a temperature suitable for dye transfer is pressed to a preferably preheated surface and/or to a limited area of the surface to be printed by means of superatmospheric gas pressure, in particular by means of a flowing gas. Additionally the surface to be printed is maintained at a temperature below the thermoplastic range during the transfer process.

19 Claims, 3 Drawing Figures

TRANSFER PRINTING PROCESS FOR SOLID OBJECTS EMPLOYING HIGH-PRESSURE GAS

This is a division of application Ser. No. 556,943, filed Dec. 1, 1983.

BACKGROUND OF THE INVENTION

1. Field of the Invention

This invention relates to an improved process for transfer printing onto solid objects (substrates) made of plastic or objects having a plastic surface coating, e.g., varnish. More specifically, the transfer printing is effected more efficiently during the dye transfer by the sheet dye carrier being pressed to the surface to be printed by super atmospheric gas pressure while the surface is kept at a temperature below the thermoplastic range of the plastic or plastic coating.

2. Description of the Prior Art

In the past, transfer printing, which is most commonly used in the fabric industry, has typically involved the process whereby a sublimable dye is tranferred to the surface to be printed using a sheet dye carrier at an elevated temperature. During the transfer, the dye carrier is pressed onto the surface of the object to be printed.

Transfer printing onto varnished surfaces of solid objects such as sheet metal strips is described in DE-A No. 29 14 704. The transfer printing takes place through the passage of the varnished metal and a transfer printing paper over a calander. In accordance with the process described in DE-A No. 26 42 350, the transfer printing along with the coating of a solid object is summarized as a process in which a thermoplastic plastic foil is laminated onto the surface of a solid object while a dye is transferred to the synthetic layer from a dye carrier. Various standard processes can be used for the lamination, such as high-frequency or ultrasound lamination or hot air sealing. Since the lamination and dye transfer take place while the coating is in a thermoplastic state, the original shine of the plastic surface is not maintained in that process.

It is highly desirable that the surface shine is maintained during transfer printing onto objects made of plastic or having a plastic surface coating such as varnish. Such a process is not found in the prior art.

SUMMARY OF THE INVENTION

In accordance with the present invenrion it has been discovered that a surface shine can be maintained during transfer printing onto objects made of plastic or having a plastic surface coating such as varnish by pressing the thin dye carrier onto the surface to be printed during the dye transfer by means of super atmospheric gas pressure, whereby the surface is kept at a temperature below the thermoplastic range.

Furrher in accordance with the present invention, an essentially uniform gas pressure is attained so as not to impair the surface shine of the object onto which printing is to be transferred.

Still further in accordance with the present invention, it is especially advantageous to use the process of the present invention for printing objects with glossy surfaces or with surfaces sensitive to pressure for other reasons.

These and other aspects of the invention will become clear to those skilled in the art upon the reading and understanding of the specification.

BRIEF DESCRIPTION OF THE DRAWINGS

The invention will be further described in connection with the attached drawing figures showing preferred embodiments of the invention including specific parts and arrangements of parts. It is intended that the drawings included as a part of this specification be illustrative of the preferred embodiments of the invention and should in no way be considered as a limitation on the scope of the invention.

DESCRIPTION OF THE PREFERRED EMBODIMENTS

Figure 1:
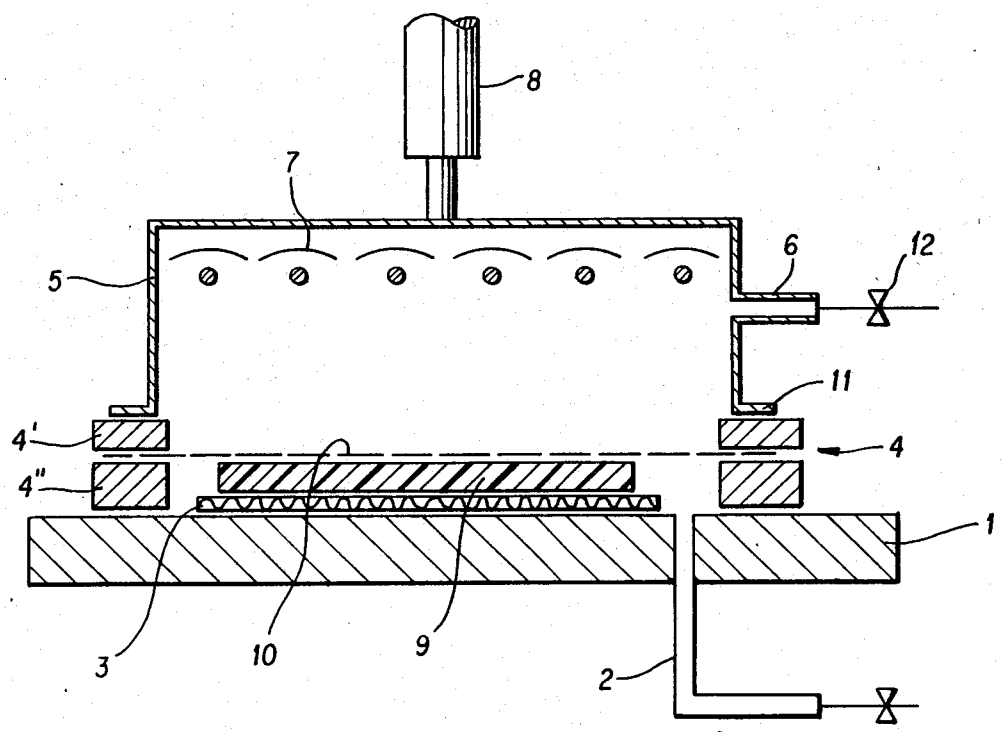
FIG. 1 illustrates a device for carrying out the transfer printing process in accordance with the present invention.

With the process according to the invention, all substrates can be printed whose surfaces have a sufficient affinity to the sublimable dyes used in transfer printing. The objects to be printed consist of a plastic or a plastic coated surface. The plastic, which forms a cohesive, i.e., a porous layer or a matrix, should have sufficient affinity for the dyes used in transfer printing; and will fuse to the thermoelastic but not to the thermoplastic state at the temperatures employed in transfer printing. Plastics, which are especially good for this process, are those that, owing to their very high molecular weight or branching or cross-linking, have no thermoplasticity, but rather soften at the most thermoelastically.

The objects, onto which printing is to be transferred that are preferred, consist entirely of plastics with a close formation plastic surface, especially flat sheets, tapes, or foils. The sheers or tapes can, for example, be 1–12 mm, preferably 2–8 mm thick. According to the invention, curved, arched, or other three-dimensional objects can be printed, for example, pipes, dome-shaped objects, plumbing fixtures, illumination advertising signs, die castings, and the like. Moreover, foam plastics that have sufficient heat resistance for example, polymethacrylimide foam plastics, can be printed in accordance to the process of the invention.

Another class of objects that may be printed in accordance to the process of the invention are those that have a plastic surface layer, for example, a laminated foil or a layer of varnish, on a base consisting of another material, such as metal (sheet metal), ceramic, brass, asbestos cement sheeting, leather, wood, particle board or hardboard, paper or cardboard. The plastic layer to be printed should be at least 10 μm thick and preferably 50 μm–1 mm thick.

A plastic especially suitable for the process according to the invention is acrylic glass. It is to be understood that acrylic glass is intended to include homopolymers of methylmethacrylate as well as copolymers consisting for the most part of this monomer, preferably at least 70%, and the remainder of other monomers that can be copolymerized with it, inclusive of acrylonitrile-methylmethacrylate copolymers. Acrylic glass can be polymerized in sheet form. This so-called cast acrylic glass has no thermoplasticity due to its molecular weight exceeding 1 million. Acrylic glass, however, can be extruded from a thermoplastically fusable molding-material. In this case, the transfer printing process can directly follow the manufacturing of the plastic sheet though extrusion. Other suitable plastics are polyethylene, polypropylene, polyvinylchloride, polystyrene, and impact-resistant butadiene-styrene plastics, polyoxymethylene, polycarbonate, fiber glass-reenforced polyester, and aminoplast synthetics.

Opaque white plastics are preferred as a rule, but transparent or translucent plastics or plastic films are also suitable.

The sheet dye carriers that normally are used in textile printing or other transfer printing processes are also suitable for the process according to the invention. They can be printed in one color or in and desired pattern or motif in one or more colors. As a general rule, the images are printed on paper using gravure, offset lithography, or screen printing processes; however, plastic or metal foils are also used as dye carriers. Special sublimable dyes are used for printing which have a sufficient affinity for the plastics to be printed.

If only a part of the surface of the object is to be printed, the dye carrier can be smaller than the surface of the object. With uneven objects it may be advisable to use separate dye carriers, which can be applied to the surface better than a single continuous piece. The individual pieces may be used simultaneously or in sequence for the transfer printing. For printing spherically dished surfaces it is sometimes advantageous to use dye carriers made of elastic plastic foils.

The dye carrier should be suitably selected so that it will not tend to form bubbles or folds under pressure. It is advantageous to pre-dry paper dye carriers below the sublimination temperature. To prevent any impairment of the surface shine, it is advisable to sprinkle a fluid or finely dispersed antiseize agent, such as talcum, on the dye carrier. The results have not been as good when the plastic surface was sprinkled. It is recommended that the dye carrier be clamped in close proximity (1–2 mm) above the surface to be printed and that it be allowed to contact the surface only in the area on which the gas is applied under pressure.

Generally the gas applied under pressure is air. Only in rare instances are inert gases like nitrogen or carbon dioxide used. The gas applied under pressure exerts a slight super-atmospheric pressure indirectly or directly on the back side of the dye carrier, and it must not cross over to the front side of the dye carrier which lies on the object to be printed. A pressure gas cushion may be used, whereby the gas applied under pressure may be contained in a pillow made of a soft foil or a textile fabric that is not stiffer than the dye carrier itself. The direct action of the gas applied under pressure cushion on the dye carrier is even more advantageous. In this case, a bell enclosing the gas cushion may be supported on the edge of the dye carrier or it can form a narrow air gap. The gas escaping through this gap must be replaced continuously to maintain the required gas pressure.

The gas pressure may be on the order of 3–200 mm, preferably 5–50 mm, water column. Higher pressures, which can lead to distorted impressions or impairment of the glossy surface, are not needed with flat substrates and flexible dye carriers.

The gas pressure is preferably produced by a flowing gas. For example, high-pressure air can be directed toward the reverse side of the dye carrier through numerous individual nozzles located a short distance away, for example 5 to 50 mm. The nozzles can consist of holes in a perforated plate located 10 to 50 mm from one another or of correspondingly separated slits. It is especially advantageous to have the flowing gas work on only a limited area of the back side of the dye carrier and to move this area over the back side of the dye carrier until the whole surface has been printed. In each area, the necessary time for the dye transfer must be allowed. It is useful to have the high-pressure air flow though a slit nozzle whose width covers the surface to be printed and which is gradually drawn across the substrate. Alternatively, the substrate may be moved under the stationary nozzle.

The required rate of flow of the gas is governed by the distance between the nozzle and dye carrier, the flexibility of the dye carrier, the dynamic pressure, which is formed in relation to the possibility of escape of the air and the like. In any event, the rate of flow must be adequate to keep the dye carrier to close contact with the substrate surface for sufficient time to transfer the printing. If the dye carrier lies flat and remains flat when the gas is introduced, the rate of flow can be lower than if the dye carrier tended to form bubbles, folds, or waves. However, the rate of flow should not be increased to such an extent that the pressure of the dye carrier leads to impressions or damage to the gloss on the substrate.

Most transfer printing dyes sublimate between 100° C. and 300° C., particularly between 150° C. and 250° C. While the dye carrier is subjected to the high-pressure gas, it must reach the sublimation temperature of the dye and maintain that temperature until the desired dye transfer has been effected. The higher the temperature of the surface to be printed, the better the transfer; however the temperature of the surface should remain below the temperature of the dye carrier, preferably below the sublimation temperature of the dye. In general the dye should be diffused to a depth of about 20 to 100 μm into the surface to be printed.

Since the dye carrier first must be heated to the sublimation temperature directly before the start of the dye transfer, and since the sublimation itself uses heat, the heat requirred to maintain the sublimation temperature must be applied from the back side to the dye carrier during the dye transfer. For example, a heat radiator may be placed in a bell that contains a high-pressure gas cushion, so that the radiation is directed toward the back side of the dye carrier. If a flowing gas is used, this gas can be heated and thus act as a heat carrier. Heat radiators can then optionally be used.

The time for the dye transfer to take place is the time of the period of contact between the surface to be printed and the dye carrier which is generally from 2 seconds to 5 minutes. Preferably the period of contact is 5 to 15 seconds. Contact periods limited to seconds presuppose not only a high temperature of the dye carrier but also preheating of the surface to be printed to as high a temperature as possible, i.e., within the previously discussed limits. With thin-walled objects like plates or foils made of plastics or sheet metals or laminates coated with plastics, it is usually sufficient to place the object on a heated support for a short period of time before the transfer printing. Thicker objects or objects having poor thermal conductivity are preheated in an oven or with heat radiators.

In printing cast acrylic glass it has proven useful to preheat the acrylic glass to 170° C.–180° C. followed by directing air heated to 250° C.–350° C. toward the back side of the dye carrier. Under these conditions, a complete dye transfer can be achieved in 5 to 15 seconds without damage to the surface shine. Similar considerations come into play for thermosetting plastics or vulcanized coatings.

If thermoplastic plastics are being printed with dyes whose sublimation temperature bodies within the softening range of the plastic, the temperature must be regulated with extreme care. The plastic should be preheated only to a temperature lying at most in the thermoelastic range but below the thermoplastic temperature range. During the period of contact with the dye carrier further heating of the surface of the plastic is unavoidable; but this heating must be limited so that the surface of the plastic does not reach the thermoplastic state. Maintenance of the surface shine is a reliable indication that the limit of the thermoplastic range has not been exceeded to the extent that irreversible deformations of the surface have occurred. The preheating temperature, the intensity of the heating effect during the dye transfer, and the period of contact are mutually adjusted so that a complete dye transfer is effected without the dye carrier sticking to the surface of the plastic, which can be taken as an indication of the thermoplastic state. Even the amount of gas pressure, or rate of gas flow, can influence the transfer of heat to the surface of the plastic. Damage may occur to the surface from sticking of the dye carrier to the surface of the plastic. This can be removed accordingly by lowering the preheating temperature; by reducing the pressure, the rate of flow, the dye transfer temperature, or the acting time of the gas applied under pressure; or by moderating the supply of the radiated heat.

Extruded acrylic glass which is in a thermoplastic state above 150° C., can be printed aocording to the invention if it is preheated to 120° C.–135° C. The dye carrier, by means of a hot air jet, is then pressed at a temperature of 150° C.–200° C., ar a rate of flow of 5–20 m/sec, during a contact period of 5–10 sec. Predyed plastic panels of a polycarbonate plastic can be similiarly treated by preheating the panels to 180° C. –200° C. which tolerate a hot air temperature of 350° C.

In the practical application of this process, care should first be taken to ensure that the dye transfer can begin as soon as the dye carrier is subjected to the gas applied under pressure. Either the surface to be printed must be sufficiently preheated before effecting the action of the gas applied under pressure or a suitable source of heat must be caused to act on the dye carrier. Preferably both conditions will be met simultaneously.

The object to be printed can be preheated in a circulating-air oven and, as long as it softens thermoelastically, It can then be placed on a suitable base that has been preferably preheated to the same temperature. The object, while on the base, can also be heated, for example, with heat radiators. The dye carrier is then applied cold and subjected to the gas applied under pressure. The dye carrier, for ease in handling, can be clamped in a frame. Following the dye transfer, the dye carrier is removed and the printed object is allowed to remain on the base until it has cooled down below the softening temperature.

To print on an extruded plastic sheeting placed on a continuously revolving steel belt, a band-shaped dye carrier taken from a feed roller is placed on the plastic sheeting at the spot where it is being cooled down from the thermoplastic state to the temperature suitable for transfer printing. By means of a hot-air jet, the sheeting is then pressed onto a slit die arranged crosswise to the direction of flow. Optionally, the sheeting successively passes under several slit dies. Thereafter, the dye carrier sheeting is removed and the printed plastic sheeting is cooled down in a cooling zone.

In order to produce patterns consisting of printed and blank surface sections on the object, i.e., partial color transfer, the process of the invention may be carried out so that the gas pressure can act in only a limited zone on a section of the reverse side of the dye carrier.

According to the method of operation thus far described, patterns are transferred from the dye carrier only to the extent that they are already present there.

In contrast, according to this embodiment, patterns are produced exactly because color is transferred onto the surface from the dye carrier from specific zones and these zones are chosen so that a pattern of printed and blank surface sections occurs on the printed surface. The terms "printed" and "blank" only refer to the transfer printing produced by this process. The surface to be printed may of course contain patterns from a preceeding operation made of blank and printed surface sections, which patterns need not necessarily match the pattern to be produced.

Patterns in the meaning of the invention are any arrangements of printed and blank surface sections that are placed on the object for technical, esthetic or other reasons. Decorative ornaments, letter and pictorial symbols, guidelines for tool control and the like may be involved.

The dye carrier used may contain a homogeneous distribution of the transferable dye over the entire surface. In this case, the printed surfaces produced by the process of the invention are all uniformly dyed. However, if a dye carrier is used that contains a pattern made of one or several colors or of color-carrying or dyestuff-free sections, then the printed surfaces are appropriately patterned or optionally are interrupted by undyed surfaces within the zone acted upon by the gas pressure.

To produce a line pattern according to the process of the invention, for example a hot, sharply limited gas jet can be blown onto the chosen zones on the reverse side of the dye carrier from a slight distance by means of a jet and can be steadily moved along the line to be produced. In this case, usually a line with diffuse side limitations occurs. The desired flat patterns develop when the gas jet is directed to gradually coat a larger zone.

A more precise limitation of the printed surfaces can be achieved if the zone of the reverse side of the dye carrier on which the gas pressure acts is limited by means of a stencil. Depending on the pattern to be produced, cut-out sheet metal or another substance not substantially deformable by the effect of gas pressure, which acts to divert the effect of the gas pressure on other zones of the reverse side of the dye carrier is suitable as a stencil.

The zones of tne reverse side of the dye carrier left blank by the stencil can gradually be coated by means of a hot gas jet until the entire pattern has been transferred. The gas space above the stencil can also be sealed against the atmosphere and can be filled with a hot pressurized gas, whereby the entire pattern can be simultaneously transferred.

Figure 2:
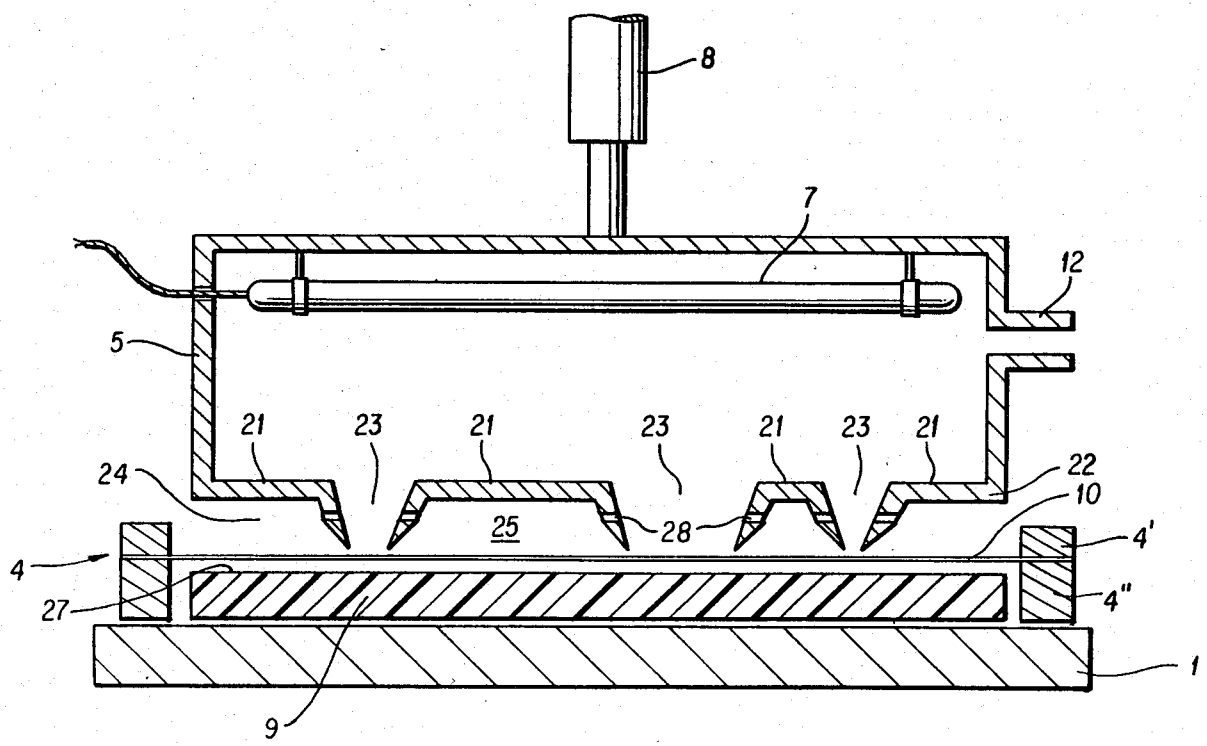
FIG. 2 illustrates a second embodiment device for carrying out the invention process.

A stencil suitable for the process of the invention is presented in FIG. 2 in cross section. To avoid uncontrolled color transfer under the masked surfaces (21) of the stencil (22) that can be caused by escaping hot gas, it is advantageous to enclose the open surfaces (23) of rhe stencil in a funnel-shaped manner (24), so that the escaping pressurized gas has sufficient room (25) for escape without pressure. Precise limits of the printed surfaces are achieved if the lower edge of the funnel-shaped borders (24) of the open surfaces (23) tapers off into a sharp cutting edge (26). If this stencil gets close to the dye carrier (10) and the surface to be printed (9), the funnel-shaped stencil walls (24) can be perforated with holes (28) through which the cooled-down pressurized gas can escape and can be replaced by inflowing hot pressurized gas. The heat required for color transfer can also be applied to the reverse side of the dye carrier by means of a radiator (7) that is arranged in the sealed pressurized gas space (5).

A laser may also be used in place of a radiator. The laser is guided along the line to be produced or it may be allowed to gradually spread over a larger surface. In rhis process a precise contour can be produced even without a stencil.

The following non-limiting Examples are affored in order that those skilled in the art may more readily understand rhe present invention and specific preferred embodiments thereof in accordance with the foregoing description of the improved process of the present invention.

EXAMPLE 1

To print on plastic sheeting, a device according to FIG. 1 is used. The device comprises a table (1) through which a vacuum line (2) is passed and on which a hotplate (3) is placed, a paper tenter frame (4) consisting of an upper and lower frame half (4') and (4''), as well as a heating bell (5) with compressed air connection (6) and a number of heat radiators (7). The bell can be raised and lowered by means of a lifting cylinder (8).

A cold plate (9) made of 5-mm thick, white, cast acrylic glass is placed on the hotplate (3) that is heated to 150° C., while the tenter frame (4) has not yet been inserted. The bell is lowered so that the radiators (7) come sufficiently close to plate (9) to heat it.

As soon as the surface of the plate (9) has reached a temperature of 150° C., which takes 5 minutes, the heating bell is raised, the paper tenter frame (4) is inserted so that it rests on the table (1) and covers the plate (9) without touching it. Between the frame halves (4') and (4'') a transfer printing paper is clamped in with the color side down. The printed side of the paper (10) has previously been lightly powdered with talcum. The thickness of the lower frame half (4'') is adjusted so that the paper (10) floats above the plate (9) at a distance of 0.1–0.5 mm. The paper becomes completely wrinkle-free because of the effect of the heat of the radiators (7).

As soon as the frame (4) is placed on the table (1), the heating bell (5) is lowered by means of the lifting cylinder (8) until its edge (11) rests on the frame (4) and seals the interior of the bell (5). By opening the compressed air valve (12), an excess pressure of 50–100 mm water column (as compared with the atmospheric pressure) is produced under the bell, whereby the paper (10) adheres to the plate (9). This can be promoted by simultaneous evacuation of the space below the paper (10) by means of the vacuum line (2); a partial vacuum of water-column of 50–100 mm (as compared with atmospheric pressure) suffices.

By means of the heat radiators (7) the paper (10) is heated to the sublimation temperature of about 220°–240° C. of the dyestuff. After 60–90 seconds a sufficient color transfer to the plate (9) to a penetration depth of 50 μm has occurred. Now excess pressure or partial vacuum is removed, the bell (5) is raised, the renter frames (4) are removed and the plate (9) is placed on a flat base. If desired it could also be placed directly into a forming device. The surface of the plate (9) after cooling down displays the color pattern transferred form the paper (10) in strong colors and has a high-gloss surface.

COMPARISON EXAMPLE 1

For comparison purposes, a transfer on a similar acrylic glass plate was performed using a heatable press. The press contains a flat lower table and parallel to it an upper table that can be raised and lowered and is heated to 220° C. by means of an electrical heating device. The following were then stacked on top of one another on the lower table in the opened press in approximately equally large parts:

a. a felt cloth of fine structure
b. a white 5-mm thick case acrylic glass plate
c. a transfer printing paper with color side down the color side was first powdered with talcum
d. release paper that has not been dyed
e. a felt cloth of fine structure.

The upper table of the press is then lowered, so that the pile is compressed by light pressure. After 5 minutes, the upper side of the acrylic glass plate has a temperature of 214° C. and the temperature of the underside is 158° C. The press is opened, the pile is taken apart and the acrylic glass plate is placed on a flat base for cooling. The color pattern has been transferred from the transfer printing paper just as strongly as in Example 1; however, the acrylic glass plate surface is dull.

EXAMPLE 2

A device according to FIG. 2 is used to produce a color pattern through partial dyestuff transfer from an evenly dyed printing paper. The latter largely corresponds to the device of Example 1, whereby, a stencil (22) with masked surfaces (21) and open surfaces (23) is arranged on the underside of the bell (5). In this case, the hotplate (3) is not needed.

An acrylic glass plate as in Example 1 is used; however, this plate is preheated to 60°–70° C. outside the device and placed on tbe table (1) as long as the bell (5) is raised by means of the lifting device (8). The frame (4) with the transfer printing paper (10), as described in Example 1 is placed on top and the bell (5) is lowered by means of the lifting device (8) to a point such that the cutting edge (26) of the stencil walls (24) touch the paper (10). Through the piping (12) hot compressed air of approximately 250° is blown into the bell (5), creating an excess pressure of 50–100 mm water column. As a result of the excess pressure that acts on the surface of the paper (10) through the open surfaces (23), the paper adheres to the plate (9). The compressed air can escape through the holes (28) in the stencil walls (24) so that hot air constantly flows from the bell (5) to the open surfaces (23).

After a reaction time of 2 minutes, adequate dyestuff transfer has taken place and the dye has penetrated into the plate (9) to a depth of about 10 μm. Now the bell (5) is raised, the frame (4) is removed and the plate (9) is placed on a flat base for cooling down. It has a color pattern that corresponds exactly to the arrangement of the open surfaces (23) and has a high-gloss surface.

According to this embodiment, the radiator (7) did not have to be switched on. However, the work can also be done with pressurized gas that has not been heated and the paper can be heated by means of the radiators (7) to the sublimation temperature of the dyestuff. In this method of operation, the holes (28) are not essential.

EXAMPLE 3

Figure 3:
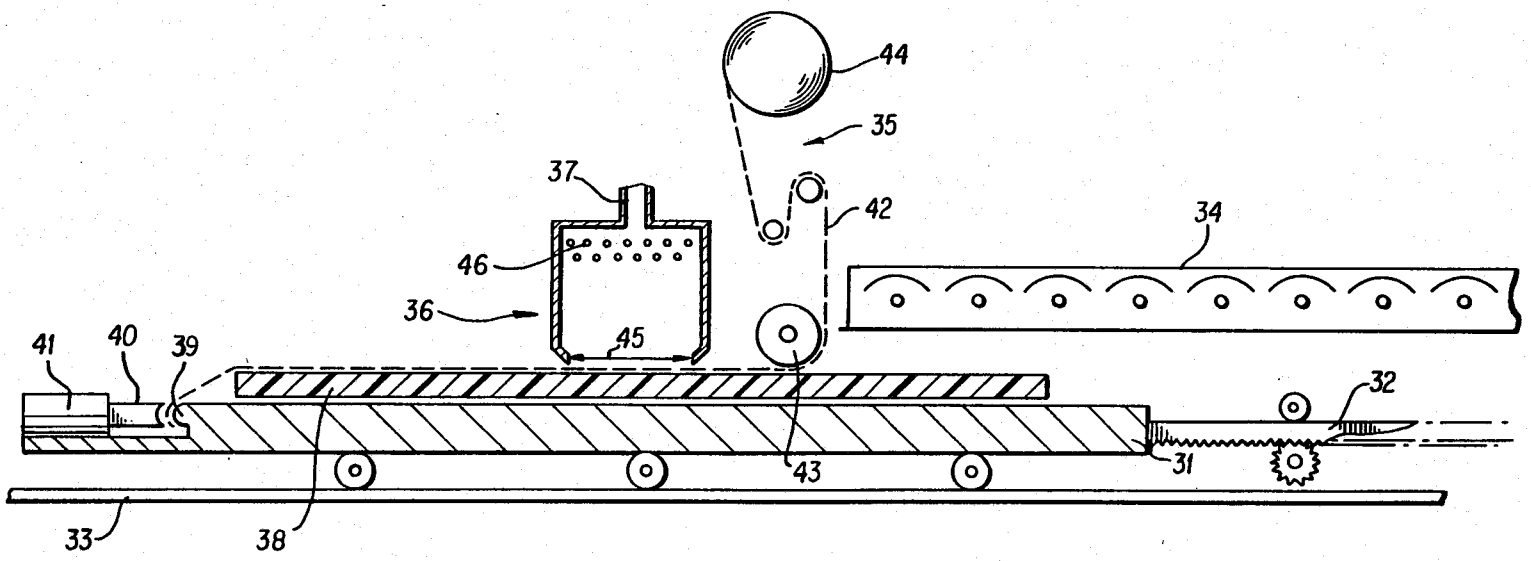
FIG. 3 illustrates a third embodiment device for carrying out the invention process.

To print on plastic sheeting in a continuous process, a device according to FIG. 3 is used. The device comprises a horizontal movable table (31) heated to 130° C. that can be moved by means of a pushing device (32) on rails (33). At the front edge (39) the table is rounded and at a distance from the edge has a clamp (40) that can be pressed by pneumatic means (41). The device further contains a radiation screen (34), a feeding device (35) for the transfer printing paper and a compressed air jet (36) that is connected to compressed air piping (37). Under the feeding device (35) a deflector roller (43) for the paper sheet is so arranged that it is at a distance from the table (31) that is 0.5–1 mm larger than the thickness of the plastic sheeting to be printed on.

A 5 mm thick plate (38) made of white extruded acrylic glass that was heated ahead of time for some hours to 80° C. to remove absorbed water is placed on the table (31) and moved with it under the radiation screen (34). The surface of the plate (38) has a temperature of 140° C. after 4 minutes. The radiation capacity of the radiation screen (34) is then reduced so that the surface temperature of the plate (38) under it remains constant.

During the preheating period the edge (39) of the table (31) is under the feeding device (35). There, the end of the paper sheeting (42) is clamped between the edge (39) and the clamp (40) by activating the pneumatic means (41). The printed side of the paper sheeting is lightly powdered with talcum. The table (31) is moved forward in the direction of the compressed air jet (36) at a speed of 0.2 m/min. In this process, the paper sheeting (42) rolls off the feed roller (44) :n the feeding device (35) and rests closely over the plate (38) behind the deflector roller (42). In this operation the color side of the paper sheeting faces down. The table (31) gradually moves under the jet (36), whereby the paper sheeting is pressed onto the plate (38) through the emergent air flow.

The compressed air jet (36) has an outlet port (45) 50 mm wide that goes across the entire width of the table (31). By means of a blower (not shown), the air is funneled through the piping (37) over heating elements (46) and heated to 225° C. The outlet port (45) is 0.5–1 mm from the top side of the plate (38) or the paper sheeting (42) is lying on it. The outlet port must not touch the paper sheeting at any point. The entry speed of the air into the piping (37) is so regulated that an excess pressure of 10–15 mm water-column occurs in the jet (36). The action time of the jet opening on every sheeting point is about 15 seconds. During this time the dyestuff transfer takes place; the depth of penetration of the dye into the plate (38) amounts to 20–50 μm.

As soon as the plate (38) has completely passed under the jet (36), the paper sheeting (42) is cut at the deflector roller (43), the cut-off part is removed from the plate (38) after opening the clamping device (39/40) and the plate is placed on a flat base for cooling down. The color pattern was transferred to the plate (38) from the paper sheeting (42) in a strong, even coloration, sharply outlined; it has an unchanged high-gloss surface.

EXAMPLE 4

The process as in Example 1 is repeated using a 5 mm thick white polycarbonate plastic sheeting that has been predried for a few hours at 120° C. The hotplate on which the plastic sheeting is placed has a temperature of 170° C. Under the conditions cited in Example 1, the plastic sheeting surface reaches a temperature of 180° C. after 4 minutes. Now the frame with the transfer printing paper is placed on top and the heated bell is lowered. The dyestuff transfer is completed after 1.5 minutes, the bell is raised, the frame is removed and the printed plate is permitted to cool down. It has a high-gloss surface.

EXAMPLE 5

On an acrylic glass plate that has not been preheated, a colored line pattern is produced by placing on the plate an evenly dyed transfer printing paper and a hor air jet is moved along a contour stencil at a distance of 10 mm from the paper sheeting. The hot air jet has an inside diameter of 5 mm. The air speed is so regulated that it produces a dynamic pressure of 40 mm water-column at a distance of 10 mm from the jet. The air temperature amounts to 300° C. The jet is moved forward at a speed of 2–4 mm/second, whereby the paper takes on a slightly brownish color. After removing the transfer printing paper, the plastic surface provides a sharply contoured line pattern in accordance with the stencil used.

While the invention has been described above with reference to certain preferred embodiments thereof, those skilled in the art will appreciate that various changes, modifications and substitutions can be made therein without parting from the spirit of the invention. It is intended, therefore, that the invention be limited only by the scope of the claims which follow.

What is claimed as new and is intended to be secured by Letters Patent is

1. A process for transfer printing onto a solid substrate made of plastic or having a surface layer of varnish or plastic thereon without impairing the surface shine thereof which comprises contacting a sheet dye carrier under pressure to the surface to be printed at a temperature suitable for the dye transfer whereby the sheet dye carrier during dye transfer is pressed onto the surface to be printed by super atmospheric gas pressure subject to the condition that said surface is maintained at a temperature below the thermoplastic range of said plastic, varnish or plastic coating.

2. The process according to claim 1, wherein the gas pressure is created by a flowing high-pressure gas directed toward the back side of the dye carrier.

3. The process according to claim 2, wherein the gas pressure is regulated to act only on a limited area on of the back side of the dye carrier, and said area is gradually moved to other parts of the back side of the dye carrier.

4. The process according to claim 3, wherein a portion of the dye carrier is maintained a slight distance from the surface of the substrate to be printed, and wherein gas pressure is subsequently applied to press the said dye carrier to the surface in an area where gas pressure was originally not applied.

5. The process according to any one of claims 1 to 4, wherein a fluid or finely dispersed solid is applied to the surface of the dye carrier as an antiseize agent before the action of the gas pressure.

6. The process according to claim 5, wherein the the surface to be printed is preheated to a temperature suitable for dye transfer prior to being subjected to said gas pressure.

7. The process according to claim 6, wherein a shaped substrate is printed.

8. The process according to claim 7, wherein several dye carriers covering only a portion of the surface to be printed are applied to the shaped substrate, simultaneously or in succession.

9. The process according to claim 1, wherein the superatmospheric gas pressure is permitted to act on only a limited zone of a section of the reverse side of the dye carrier to produce patterns consisting of printed and blank surface sections.

10. The process according to claim 9 wherein the section of the reverse side of the dye carrier which is acted on by the gas pressure is limited by means of a stencil that prevents the action of the gas pressure on other parts of the reverse side of the dye carrier.

11. The process according to claim 1 wherein said dye transfer is effected on a continuous substrate.

12. The process according to claim 1, wherein said surface to be printed has a thickness of least 10 μm.

13. The process according to claim 4, wherein said dye carrier is maintained at about 1 to 2 mm from said surface to be printed.

14. The process according to claim 2, wherein said gas pressure is within the range of about 3 to 200 mm water column.

15. The process according to claim 3, wherein said gas pressure is applied at a distance of about 5 to 50 mm from the back side of said dye carrier.

16. The process according to claim 6, wherein the temperature, at which said surface to be printed is preheated, is below the sublimation temperature of the dye.

17. The process according to claim 2 wherein the time period of contact for the dye carrier to the surface of the object to be printed is from about 2 seconds to about 5 minutes.

18. A shaped substrate wherein the surface of the substrate is printed according to the process of claim 1, wherein said dye is diffused into the surface of the substrate to a depth of about 20 μm to about 100 μm without impairment to the surface shine of said substrate.

19. The object according to claim 18, which consists of acrylic glass.

* * * * *